United States Patent [19]

Moon et al.

[11] 4,306,576

[45] Dec. 22, 1981

[54] CIGARETTE FILTER

[76] Inventors: Suk Moon, c/o George Spector, 3615 Woolworth Bldg., 233 Broadway; George Spector, 3615 Woolworth Bldg., 233 Broadway, both of, New York, N.Y. 10007

[21] Appl. No.: 66,172

[22] Filed: Aug. 13, 1979

[51] Int. Cl.[3] ..... A24F 13/02; A24F 7/04

[52] U.S. Cl. ..... 131/187; 131/331; 131/346

[58] Field of Search ..... 131/187, 263, 10 R, 131/10.5, 10.9, 170 R, 201, 202, 261 B

[56] References Cited

U.S. PATENT DOCUMENTS

| | | | |
|---|---|---|---|
| 3,167,076 | 1/1965 | Mare | 131/10.5 |
| 3,194,246 | 7/1965 | Mantchev | 131/263 X |
| 3,370,592 | 2/1968 | Schultz et al. | 131/263 X |

FOREIGN PATENT DOCUMENTS

| | | | |
|---|---|---|---|
| 900370 | 10/1944 | France | 131/263 |
| 713630 | 9/1966 | Italy | 131/263 |
| 1094642 | 12/1967 | United Kingdom | 131/263 |

*Primary Examiner*—Stephen C. Pellegrino

[57] ABSTRACT

A tar and nicotine filter device attachable to one end of a cigarette, including a molded, hard plastic tube for placing in a persons mouth, the tube containing two filter cartridges spaced apart by a tar trap therebetween, the invention in one design containing a cotton wad in the tar trap that is made to be visible so to inform a smoker when the device is tar saturated so to be discarded, and in another design of the invention, the tube is made of two interfitted pack so to allow opening and replacing the saturated cartridges.

1 Claim, 5 Drawing Figures

CIGARETTE FILTER

This invention relates generally to cigarette filters.

Heretofore numerous filter attachements have been made for cigarettes, but it seems that none has proved ideal so that the same is not continued to be used after becoming saturated with tars and nicotine.

Accordingly, it is a principal object of the present invention to provide a cigarette filter which in one design includes a visual indicator so as to inform a smoker when the filter is saturated and should be discarded.

Another object is to provide a cigarette filter which in another design can be opened up so to remove saturated filters and replace them with fresh filters.

Figure 1:
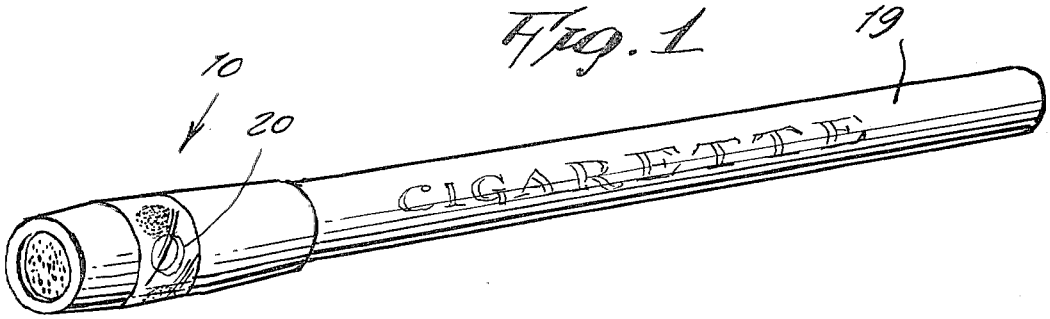
FIG. 1 is a perspective view of one design of the invention that includes visual means for indicating when the filter should be discarded.
Figure 2:
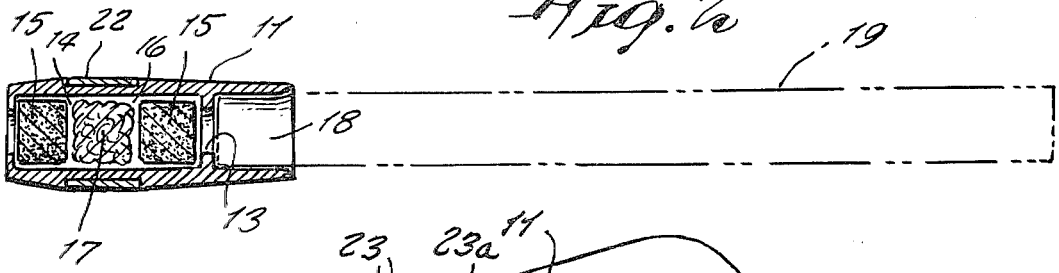
FIG. 2 is a longitudinal cross sectional view thereof.
Figure 2:
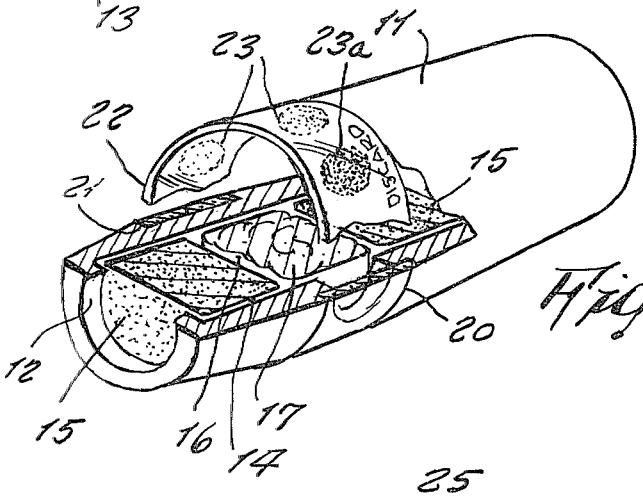
Figure 3:
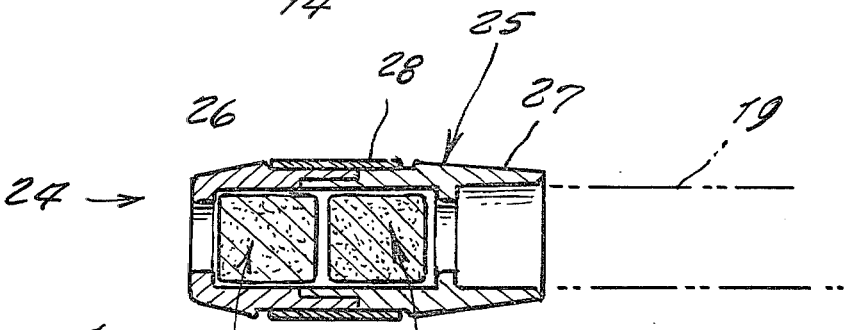
FIG. 3 is a fragmentary cross sectional perspective view thereof.

Referring now to the drawing in greater detail, and more particularly to FIGS. 1 to 3 thereof, at this time, the reference numberal 10 represents a cigarette filter according to the present invention, wherein the same includes a tube 11 made of molded hard plastic. A radially inwardly bead 12 at one end and an intermediate inward bead 13 form a chamber 14 into which two cylindrical shaped filter cartridges 15 are placed spaced apart so to form a tar trap 16 therebetween into which a cotton wad 17 is placed. A chamber 18 in one end of the tube serves to receive one end of a cigarette 19.

A singular opening 20 is made through the tube wall at the tar trap area so as to allow observation of the cotton wad. An annular groove 21 at this point around the tube retains slidably free a circular ring 22 made of a transparent plastic upon which there are printed a row of circular spots 23, each one of which is progressively a darker shade, commencing with a lightest one at one end, the shade of the spots being a color such as that of tar derived from a cigarette smoke.

In operative use, the filter device 10 can be re used over and over from one cigarette to another, until such time that the filters get saturated with nicotines and tars get collected on the cotton wad in the tar trap. A smoker can readily learn when this occurs so to discard the device, by simply rotating the ring 22 and compare the density of tint or hue of the color of the spots 23 to that of the cotton wad. One of the spots 23*a* is identified with the tex "Discard" therebeside, so that when the wad has become saturated to this depth of hue by the smoke residues of of nicotine and tar, the device should then be discarded as it can no longer catch more of these substances and should promptly be replaced.

Figure 4:
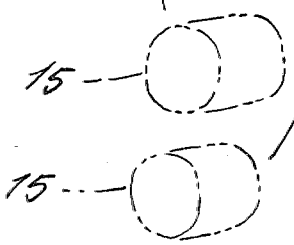
FIG. 4 is a longitudinal cross section of another design of the invention in which filter cartridges are replacable.

In FIG. 4, another design of filter device 24 includes a tube assembly 25 made of two tubes, 26 and 27 interfitted together so to provide access to the chamber 14 when pulled apart, and allow removal of saturated filter cartridges and replaced with fresh ones. Thus in this design the device 24 is not discarded when the cartridges are saturated. Accordingly, the above described cotton wad 17, view opening 20, and ring 22 with spots 23 are not included in the construction. A tape 28 holds the tubes together.

Figure 5:
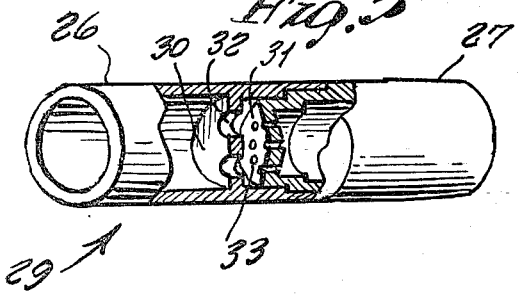
FIG. 5 is a cross sectional perspective view of still another design thereof.

In FIG. 5 a further modified design 29 of device is generally simular to device 24 except that each tube 26 and 27 additionally include partitions 30 and 31 with the accessible tar trap therebetween, one partition 30 having two larger holes 32 therethrough while the other partition has numerous small holes 33 therethrough. The two filters fit into one end of the device.

What is claimed:

1. A filter device attachable on one end of a cigarette, comprising in combination, a tube having a mouthpiece, a recess at the inner end of said tube for receiving said cigarette including a middle chamber between said mouthpiece and said recess, wherein said middle chamber includes a pair of spaced filters, said tube includes a transparent band rotatably mounted about the tube periphery superimposed over an opening in said tube communicating with said chamber, an absorbent wad in said chamber between wherein the band has means for determining the degree of discolorization of the wad to justify discarding the device.

* * * * *